US005623877A

United States Patent [19]

Muth

[11] Patent Number: 5,623,877

[45] Date of Patent: Apr. 29, 1997

[54] METHOD AND APPARATUS FOR PREPARING A PRINTING PLATE

[75] Inventor: Bernhard W. W. Muth, Veitshöchheim, Germany

[73] Assignee: Koenig & Bauer-Albert Aktiengesellschaft, Wurzburg, Germany

[21] Appl. No.: 563,551

[22] Filed: Nov. 28, 1995

[30] Foreign Application Priority Data

Nov. 30, 1994 [DE] Germany ..... 44 42 574.0

[51] Int. Cl.[6] ..... B41L 3/02

[52] U.S. Cl. ..... 101/486; 101/477

[58] Field of Search ..... 101/DIG. 36, 481, 101/485, 486, 415.1, 378, 382.1, 383, 389.1, 477

[56] References Cited

U.S. PATENT DOCUMENTS 4,727,807 3/1988 Suzuki et al. .

5,259,314 11/1993 Sugiyama ..... 101/477

5,331,892 7/1994 Seib et al. ..... 101/477

5,331,893 7/1994 Wieland ..... 101/486

5,537,926 7/1996 Beisel et al. ..... 101/477

FOREIGN PATENT DOCUMENTS 4219822 12/1993 Germany .

1-176558 7/1989 Japan .

*Primary Examiner*—Ren Yan

*Attorney, Agent, or Firm*—Jones, Tullar & Cooper, P.C.

[57] ABSTRACT

Printing plates that are to be attached to a plate cylinder are suspended by their leading edges on suspension edges of a shiftable plate preparation device. This device can be moved to a plate mounting position where it overlies a plate storage device that is integrated with an inking system protector. The printing plates can be removed from the plate preparation device and carried to the plate cylinder by a printing plate manipulating device.

3 Claims, 2 Drawing Sheets

METHOD AND APPARATUS FOR PREPARING A PRINTING PLATE

FIELD OF THE INVENTION

The present invention is directed generally to a method and apparatus for preparing a printing plate. More specifically, the present invention is directed to a method and apparatus for preparing one or more printing plates adjacent a plate handling device. Most particularly, the present invention is directed to a method and apparatus for preparing a printing plate by use of a printing plate preparation device so that the prepared plate or plates can be mounted on a printing cylinder of a rotary printing press. The printing plate or plates are placed into a printing plate preparation device either manually or by utilization of a printing plate feeding device in the form of a three axis robot. The printing plate preparation device is movable between a plate preparation position and a printing plate mounting or standby position. Plates can be removed from the preparation device in the mounting position and secured to a printing plate cylinder.

DESCRIPTION OF THE PRIOR ART

In the field of rotary printing, it is frequently necessary to change printing plates in an expeditious manner. It is beneficial to avoid having the printing press stand idle for a long period of time. Thus it is desirable to be able to prepare the next printing plate which will be mounted on the plate cylinder and to have this prepared printing plate situated adjacent the plate cylinder so that it can be quickly and easily attached to the plate cylinder.

One prior art method and apparatus for mounting printing plates is shown in German Patent Publication DE 42 19 822 A1. In this prior art publication there is disclosed a preparation device on which a printing plate to be mounted on the printing cylinder is prepared. The preparation device is within the range of movement of a robot. This preparation device includes a stationary frame with a hook rail. The printing plate is suspended in this stationary frame and is transported by the robot from the preparation device to the vicinity of the printing plate cylinder where it is then mounted on the plate cylinder.

One significant limitation of this prior art device is that it requires a substantial amount of space. When two printing plate cylinders are located near to each other, the space becomes very restricted if this prior art plate mounting device is used. When the space between the printing plate cylinders becomes compromised by these prior art preparation devices, access to the plate cylinders becomes very restricted and is thus made much more difficult. The accessibility to the printing plates is also made that much more difficult by the inclusion of a device for use in supporting one end of the printing plate to be mounted on the plate cylinder.

A particular limitation of the prior art plate mounting device discussed in the German Patent Publication DE 42 19 822 A1 is that the robot device must perform complicated movements in several axes. For example, this robot device must execute various pivot movements for transporting the printing plate. The robot device is thus quite complicated and is expensive to construct.

Japanese Patent Publication JP 1-176558 and U.S. Pat. No. 4,727,807 both disclose devices in which the printing plate is prepositioned while being suspended. The printing plate is subsequently mounted on a plate cylinder by use of a multi-axial manipulating device.

It will be seen that a need exists for a printing plate preparing device that overcomes the limitations of the prior art devices. The printing plate preparing device and its method of use in accordance with the present invention, provides such a device and is a significant improvement over these prior art devices.

SUMMARY OF THE INVENTION

It is an object of the present invention to provide a method and an apparatus for preparing a printing plate.

Another object of the present invention is to provide a method and apparatus for preparing a printing plate for mounting on a plate cylinder of a rotary printing press.

A further object of the present invention is to provide a method and apparatus for preparing a plate cylinder for mounting and having a manipulating device for transporting the plate which travels over only a short distance between a plate preparation position and a plate mounting or standby position.

Yet another object of the present invention is to provide a method and apparatus for preparing a printing plate which makes possible the simple preparation of the printing plate without restricting the access to the printing units.

As will be discussed in detail in the description of the preferred embodiment which is presented subsequently, the method and apparatus for preparing a printing plate for mounting on a plate cylinder of a rotary printing press in accordance with the present invention uses a plate handling device to remove a prepared printing plate from a printing plate preparation device. The plate preparation device has at least one suspension strip which receives the leading end of a printing plate. The preparation device is shiftable between a plate preparation position remote from the printing cylinder, in which the printing plate or plates are suspended in a generally vertical position, and a printing plate mounting position or standby position in which the plates are generally horizontal. In this standby position of the plate preparation device, the leading edges of the plate or plates in the preparation device are situated so that they can be easily grasped by the plate manipulating device and moved into position for mounting on the plate cylinder.

In the present invention, the existing inking system protector or shield is modified slightly and is used as a portion of the plate preparation device. Thus the device for preparing printing plates in accordance with the present invention utilizes little or no additional space adjacent the printing cylinders. Since virtually no additional space is used, the device for preparing plates in accordance with the present invention does not require modification of the press structure and does not compromise access to the printing plate.

Because the present invention utilizes an intermediate printing plate storage device for the printing plates in the vicinity of the plate cylinder, the exchange of printing plates on the plate cylinder can be accomplished very rapidly. The printing plate manipulating device needs to travel only a very short distance for transporting and for mounting the printing plates. This significantly reduces the set-up time required for the printing presses. Such a reduction in set-up time is clearly beneficial from a production standpoint.

The manipulating device that is used to move the prepared printing plates from the plate preparation device to the printing plate cylinder is required to move on only one level generally in a simple, reciprocating manner. This means that no complicated pivot mechanisms are required. Thus the device is quite simple and inexpensive.

The printing plate that will be placed on the plate cylinder is initially prepared at a point remote from the press and is then positioned in the printing plate preparation device while the device is in its preparation position away from the plate cylinder. This allows for easy access for manual operation as well as ease of access to the automatic transport systems in a danger free manner.

The method and apparatus for preparing a printing plate in accordance with the present invention overcomes the limitations of the prior art. It is a substantial advance in the art.

BRIEF DESCRIPTION OF THE DRAWINGS

While the novel features of the method and apparatus for preparing a printing plate in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
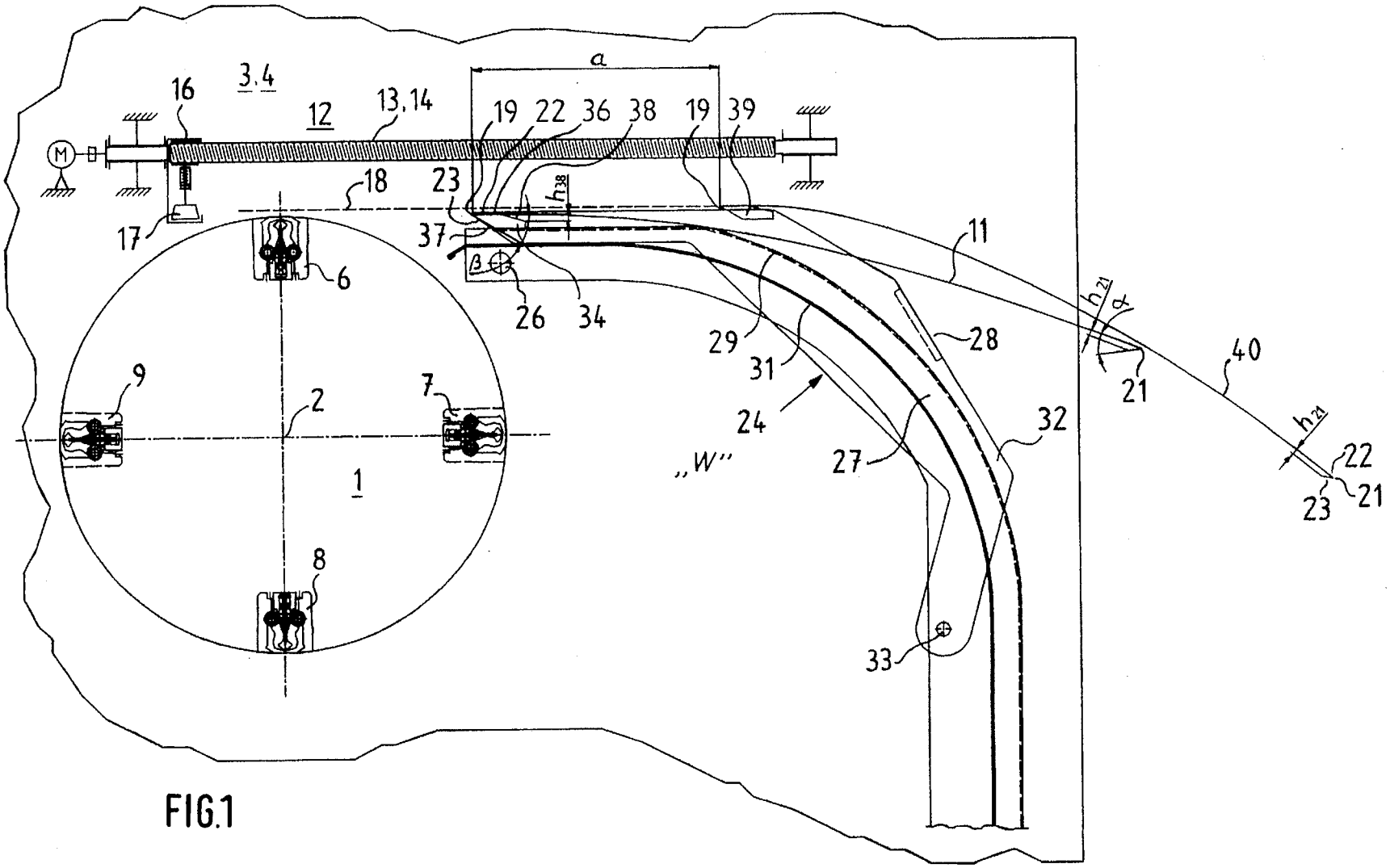
FIG. 1 is a schematic side elevation view of the device for preparing a printing plate in accordance with the present invention and showing the device in the plate mounting or standby position "W"

Referring initially primarily to FIG. 1, a plate cylinder 1 of a rotary printing press is supported between spaced lateral press side frames 3 and 4, and is rotatable around its cylinder axis 2. This plate cylinder 1 is provided with printing plate end fastening elements 6, 7, 8 and 9 for receiving the leading ends of printing plates, such as plates 11 and 40. In the instant example, four such fastening elements 6, 7, 8 and 9 are disposed in the plate cylinder 1, with each fastening element extending in the axial direction of cylinder 1 and parallel with the cylinder axis 2. The length of each of the fastening elements 6, 7, 8 and 9 is approximately one-half of the cylinder length. These fastening elements 6, 7, 8 and 9 are thus divided over the printing plate width so that two printing plates 11 or 40 are secured in each fastening element 6, 7, 8 and 9 and can each be independently actuated within this division as well as in respect to each other. The fastening elements 6, 7, 8 and 9 are offset from each other in the circumferential direction of the plate cylinder 1 by approximately 90°. A fastening element 8, 9 is respectively disposed opposite each fastening device 6, 7. It will be understood that the printing cylinder 1 is generally conventional in structure and operation, as is the rotary printing press in which it is supported. The press itself forms no part of the present invention and is thus not discussed in detail.

A printing plate manipulating device, generally at 12, is disposed between the lateral frames 3 and 4 and is usable for mounting, removing and transporting printing plates 11 or 40. The plate manipulating device 12 essentially consists of two spaced linear drives 13 and 14 that are fixed in place on the frames 3 and 4, a cross arm 16 extending axially between the drives 13 and 14 and parallel with the cylinder axis 2, and a number of plate gripper devices 17, for example four gripper devices 17. The gripper devices 17 are fastened on the cross arm 16, which is moved by the synchronized rotation of the linear drives 13, 14. In this way, the gripper devices 17 are moved on a transport level 18 which extends parallel with the linear drives 13 and 14 as well as with a tangential line defined by the plate cylinder 1 and the prepositioned printing plate 11. As may be seen most clearly in FIG. 1, each of the linear drives 13 or 14 is a lead screw that is turned by a schematically depicted reversible motor M. The cross arm 16 is carried by the linear drives 13 and 14 and is moved either to the left or to the right, as shown in FIG. 1, by rotation of the linear drives 13 and 14 in a synchronous manner.

The printing plates 11 and 40 used are each provided with front and rear suspension edges 19 and 21, which cooperate with the fastening elements 6, 7, 8 and 9 of the plate cylinder 1. The suspension edges 19 and 21 are structured to be dimensionally stable and each have legs 22 and 23 with an opening angle $\alpha$, for example of 45°. A height h21 of the suspension edges 19, 21 is a function of this opening angle $\alpha$ and of the length of the legs 22, 23. As may be seen in FIG. 1, the legs 22 and 23 of each suspension edge 19 or 21 cooperates to form a receptacle or pocket at the front and rear portions of each of the printing plates 11 or 40. These front and rear suspension edges 19 and 21 thus are engageable with the printing plate fastening elements 6, 7, 8 and 9 to secure the front and rear ends of a printing plate 11 or 40 to the surface of the plate cylinder 1.

Figure 2:
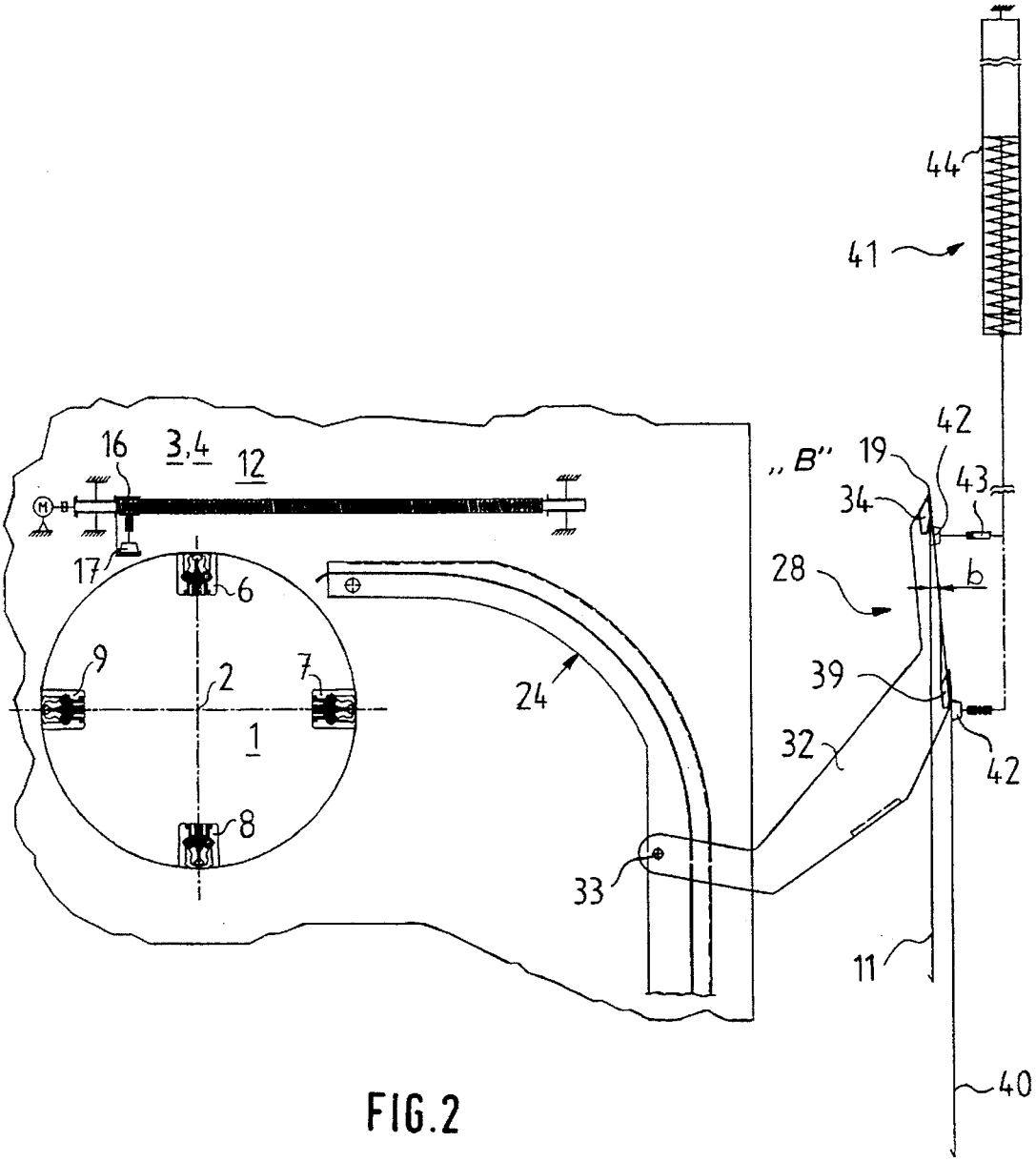
FIG. 2 is a schematic side elevation view of the device in accordance with the present invention and showing the device in the printing plate preparation position "B".

As may be seen most clearly in FIG. 2, an inking system protector 24 is associated with the plate cylinder 1. This inking system protector 24 serves a dual function in the present invention. It performs its usual and conventional function of protecting an inking system, that is not depicted in the drawings, from damage and from debris. In accordance with the present invention, this inking system protector 24 also functions as a printing plate storage device 24. The printing plate ink protector and plate storage device 24 is supported at its first end adjacent the plate cylinder 1 for upward pivotal movement by means of shaft journals 26 which extend between the lateral side frames 3 and 4. The inking system protector and plate storage device 24 consists of a plate removal chute 27, and of a printing plate preparation device 28. The two separate components 27 and 28 may be seen more clearly in FIG. 2.

The printing plate removal chute 27 which is used to receive used printing plates 11 from cylinder 1, has an upper wall 29 and a lower, opposite, wall 29. The removal chute 27 is positioned so that its upper end near the cylinder 1 is approximately parallel with the transport level 18 of the printing plate 11 or 40. This upper straight end of removal chute 27 near the cylinder 1 is followed by a section in the shape of a quarter circle which, in turn, terminates in a lower straight part. The printing plate preparation device 28 is pivotably seated with respect to the cylinder axis 2, on the printing plate storage assembly 24. The printing plate preparation device 28 has two spaced pivot arms 32, which are pivotably connected by means of shaft journals 33, to both sides of the plate removal chute 27 which is part of the printing plate storage device 24. On their free ends near the cylinder 1, these two spaced pivot arms 32 are connected by a first suspension strip 34. This suspension strip 34 extends axially parallel with the cylinder axis 2 and has a nose-shaped or somewhat wedge shaped cross section. The cross section of the suspension strip 34 is adapted, in the direction of the plate cylinder 1, to the shape of the front suspension edge 19 of the printing plate 11 or 40. In the preferred embodiment, a first support surface 36 of the suspension strip 34 is generally parallel with the transport level 18. A second suspension surface 37, adjoining the first suspension surface 36 in the direction of the plate cylinder 1, forms an opening angle $\beta$ of, for example 45°, with the first support surface 36. An end of the suspension strip 34 that is facing away from the plate cylinder 1 is provided with a chamfer 38 which is structured such that a height h38 of the chamfer 38, with respect to the support surface 36, is greater than a height h21 of the rear suspension edge 21 of the printing plate 11. In this way, the chamfer 38 is used as a guide surface for the suspension strip 34 for the rear suspension edge 21 of the printing plate 11. In addition to the first suspension strip 34, it is possible, as shown in the preferred embodiment, to fasten a second suspension strip 39 between the pivot arms 32 and remote from the cylinder 1. Alternatively, this second suspension strip 39 can also have its own pivot arms 32 and can therefore be pivotably seated independently of the first suspension strip 34. This second suspension strip 39 is used to receive, and to support, the leading end of a second, fresh printing plate 40.

The first and second suspension strips 34, 39 are each provided with stops, not shown, for the axial positioning of the printing plates 11, 40. The printing plate preparation device 28 can be moved by means of drives, not shown, from a standby or plate mounting position "W" near the cylinder, which is used for mounting the printing plates 11 or 40 on the plate cylinder 1 as shown in FIG. 1, into a preparation position "B" remote from the cylinder, which is used for placing the printing plates 11 or 40 on the suspension strips 34 or 39. This preparation position "B" is shown in FIG. 2. In the standby position "W", the first or upper support surface 36 of the first suspension strip 34 lies approximately parallel with the transport level 18. In other words, the suspension strip 34 and thus the printing plate 11 are located approximately horizontally, as shown in FIG. 1. By pivoting the printing plate preparation device 28 through approximately 90°, the printing plate preparation position "B" is reached. In this position, the support surface 36 of the suspension strip 34 and thus the printing plates 11 and 40 are located approximately vertically. If two suspension strips 34 and 39 are provided, they are offset in the preparation position "B", viewed in the vertical direction, in such a way that a space of the width "b" exists between the suspended first printing plate 11 and the second suspension strip 39 for the suspended second printing plate 40.

The suspension of the printing plates 11 and 40 can be performed manually or, as depicted in FIG. 2 of the preferred embodiment, by utilization of a plate feed device 41. This plate feed device 41 can consist of a three-axis plate feed robot 41, whose first axis lies in the direction of the cylinder axis 2, whose second axis in the vertical direction and whose third axis in the horizontal direction. This plate feed robot 41 is provided with a suction gripper 42 for receiving the printing plates 11 and 40. The plate feed robot 41 moves a printing plate 11 or 40, fastened on the suction gripper 42, into an axial position which is predetermined with respect to the plate cylinder 1. After having achieved the axial position, the printing plate 11 or 40 is placed into a horizontal position corresponding to the position of the suspension strip 34, for example, by use of a pneumatic cylinder 43. Subsequently a suitable vertical position of the plate 11 or 40 is achieved, for example, by means of a second pneumatic cylinder 44. In this way, the fresh, first printing plate 11 is vertically and axially prepositioned and suspended by its front suspension edge 19 in the suspension strip 34 by the operation of the three axis plate feed robot 41. This positioning process can be repeated several times so that several printing plates 11 or 40 can be located in properly axial spaced positions on the first and second suspension strips 34 and 39 of the printing plate preparation device 28. It will be understood that when there is provided a second suspension strip 39 that the plate suspension process is still performed by the robot 41 but with the vertical position of the suction gripper 42 of the robot 41 being matched to the location of the second suspension strip 39.

After the desired number of printing plates 11 or 40 has been suspended in the first suspension strip 34, or the second suspension strip 39, the printing plate preparation device 28 with its suspension strips 34 and 39 pivots over 90° from its preparation position "B" into its standby position "W", so that the suspended printing plates 11, 40 lie approximately parallel with the transport level 18, and thus are approximately horizontal in the preferred embodiment, as depicted in FIG. 1. The manipulating device 12 can now grasp the printing plates 11 or 40, which have been prepositioned in this manner, transport them to a fastening device 6, 7, 8 or 9 of the plate cylinder 1 and suspend them in this fastening device 6, 7, 8 or 9.

The movement for shifting the suspension strips 34 and 35 from their horizontal standby or plate mounting position "W" near the cylinder to their vertical preparation position "B" remote from the cylinder can also take place, instead of by the previously described pivot movement, by means of a guide path, hinged coupling or a combined linear and pivot movement. In the preferred embodiment, one suspension strip 34 or 39 is provided for all, for example all four printing plates 11 or 40 to be placed in the axial direction. In other words, all adjoining printing plates 11 and 40 to be exchanged on a plate cylinder 1 having two printing plates 11 and 40 in the circumferential direction are moved together from the preparation position "B" into the standby position "W" when two suspension strips 34 and 39 are provided. If only one suspension strip 34 is provided, it is possible, for example, to repeat the pivot process. It is also possible to assign each axial cylinder section associated with a printing plate 11 or 40 with its own, independently pivotable printing plate preparation device 28.

While a preferred embodiment of a method and apparatus for preparing a printing plate in accordance with the present invention has been set forth fully and completely hereinabove, it will be apparent that a number of changes, for example in the overall size of the plate cylinder, in the drive assembly for the plate cylinder, in the drive motors for the printing plate manipulating device and the like can be made without departing from the true spirit and scope of the present invention which is accordingly to be limited only by the following claims.

What is claimed is:

1. A method for preparing printing plates having front suspension edges for mounting on a plate cylinder of a rotary printing press including:

providing a movable printing plate preparation device;

positioning at least a first printing plate leading edge suspension strip on said movable printing plate preparation device;

supporting said plate preparation device for movement between a plate preparation position remote from said plate cylinder and a plate mounting position adjacent said plate cylinder;

positioning a front suspension edge of a first printing plate on said printing plate leading edge suspension strip and orienting said first printing plate in a generally vertical orientation while said plate preparation device is in said preparation position;

moving said plate preparation device and said first printing plate from said plate preparation position to said plate mounting position adjacent said plate cylinder;

providing a printing plate manipulating device adjacent said plate cylinder and adjacent said printing plate suspension edge of said printing plate preparation device when said printing plate preparation device is in said plate mounting position; and operating said printing plate manipulating device to transfer said printing plate leading edge from said plate preparation device to said plate cylinder.

2. The method of claim 1 further including mounting additional printing plates on said printing plate preparation device and jointly moving all of said printing plates to said plate cylinder.

3. The method of claim 1 further including providing separate printing plate preparation devices for each printing plate to be mounted on said plate cylinder and moving each said preparation device to said plate mounting position independently.

* * * * *